United States Patent [19]

Ahroni

[11] Patent Number: 4,778,398

[45] Date of Patent: Oct. 18, 1988

[54] SAFETY COVER ASSEMBLY FOR END CONNECTORS

[76] Inventor: Joseph M. Ahroni, 2701 W. Manor Pl., #204, Seattle, Wash. 98199

[21] Appl. No.: 57,999

[22] Filed: Jun. 4, 1987

Related U.S. Application Data

[63] Continuation-in-part of Ser. No. 865,795, May 27, 1986, Pat. No. 4,678,257.

[51] Int. Cl.[4] ..... H01R 13/506

[52] U.S. Cl. ..... 439/143; 439/145

[58] Field of Search ..... 439/135-145, 439/149

[56] References Cited

U.S. PATENT DOCUMENTS

| | | | |
|---|---|---|---|
| 1,756,933 | 5/1930 | Bateholts | 439/459 |
| 1,846,037 | 2/1932 | Missel | 439/695 |
| 2,211,591 | 8/1940 | Benander | 439/459 |
| 2,495,206 | 1/1950 | Brus | 439/695 |
| 2,717,365 | 9/1955 | Greenbaum | 439/14 |
| 2,810,895 | 10/1957 | Odegaard | 439/650 |
| 2,932,000 | 4/1960 | Buchanan | 439/569 |
| 2,932,811 | 4/1960 | Abraham et al. | 439/148 |
| 3,816,819 | 6/1974 | Judd | 439/409 |
| 3,876,273 | 4/1975 | Schwartz | 439/148 |
| 4,108,527 | 8/1978 | Douty et al. | 439/465 |
| 4,160,576 | 7/1979 | Vettori | 439/191 |
| 4,178,061 | 12/1979 | Ahroni | 337/198 |
| 4,206,957 | 6/1980 | Ludwig et al. | 439/142 |
| 4,228,317 | 10/1980 | Cziment | 439/142 |
| 4,250,349 | 2/1981 | Bennett | 174/67 |
| 4,274,698 | 6/1981 | Ahroni | 337/198 |
| 4,354,727 | 10/1982 | Brown | 439/787 |
| 4,408,813 | 10/1983 | Koehler | 439/148 |
| 4,435,032 | 3/1984 | Abramson et al. | 439/136 |
| 4,443,050 | 4/1984 | Taylor | 439/397 |

*Primary Examiner*—Gil Weidenfeld
*Assistant Examiner*—Gary F. Paumen
*Attorney, Agent, or Firm*—Seed and Berry

[57] ABSTRACT

A safety cover of simple and economical construction which will automatically return from an inactive position to a covering position responsive to removal of a plug from the related socket openings. This is accomplished by spring-leading the cover by a leaf spring element, preferably made integral at one of its ends with the cover. The leaf spring is anchored to the body of the end connector and extends at approximately a right angle to the cover. To move the cover from safety position to inactive position, it is pushed endwise in the direction of the leaf spring element, thereby bending and biasing the latter away from the end connector housing to which it remains attached. When the plug is later disconnected from the end connector, the biased leaf spring element returns the cover to the safety position.

3 Claims, 2 Drawing Sheets

SAFETY COVER ASSEMBLY FOR END CONNECTORS

RELATED APPLICATIONS

This application is a continuation-in-part of application Ser. No. 865,795, filed May 27, 1986, now U.S. Pat. No. 4,678,257.

TECHNICAL FIELD

The present invention relates to end connectors fitted to the ends of electrical extension cords and presenting multiple sets of socket openings for receiving the blades of plugs from other cords, and more particularly, to safety covers for covering such sets of openings when not being used.

BACKGROUND ART

Various safety covers have been devised for covering plug blade-receiving socket openings of extension cord end connectors. These safety covers have taken the form of slide plates mounted on the end connectors, or removable covers with plug elements adapted to fit into one or both of the openings of each set of socket openings. The slide type of covers normally remain connected to the end connector and present a set of openings which register with a respective set of socket openings in the associated end connector when the connector is in an inactive position, ready to receive therethrough the blades of a plug. Then, to cover the mouth of the socket openings when the plug is removed, the cover must be manually shifted if it is to then cover the socket mouths so that a child, for example, cannot insert a foreign object in the end connector. In the case of covers of the type having plug elements, the cover is commonly mounted on the cord adjacent the end connector and is manually manipulated to insert or remove the plug elements.

In the case of either the slide type or plug-in type of safety covers, the cover must be manipulated to return the cover to safety position after the related end connector socket openings have been used. This, of course, means that the person removing the plug from the connector must remember to return the cover to a covering position in order for the cover to carry out its safety function.

DISCLOSURE OF THE INVENTION

The present invention provides a safety cover of simple and economical construction which will automatically return from an inactive position to a covering position responsive to removal of a plug from the related socket openings. This is accomplished by spring-leading the cover by a leaf spring element, preferably made integral at one of its ends with the cover. The leaf spring is anchored to the body of the end connector and extends at approximately a right angle to the cover. To move the cover from safety position to inactive position, it is pushed endwise in the direction of the leaf spring element, thereby bending and biasing the latter away from the end connector housing to which it remains attached. When the plug is later disconnected from the end connector, the biased leaf spring element returns the cover to the safety position. Anchoring of the spring element to the end connector housing is preferably accomplished by a snap fit.

BEST MODE FOR CARRYING OUT THE INVENTION

Figure 1:
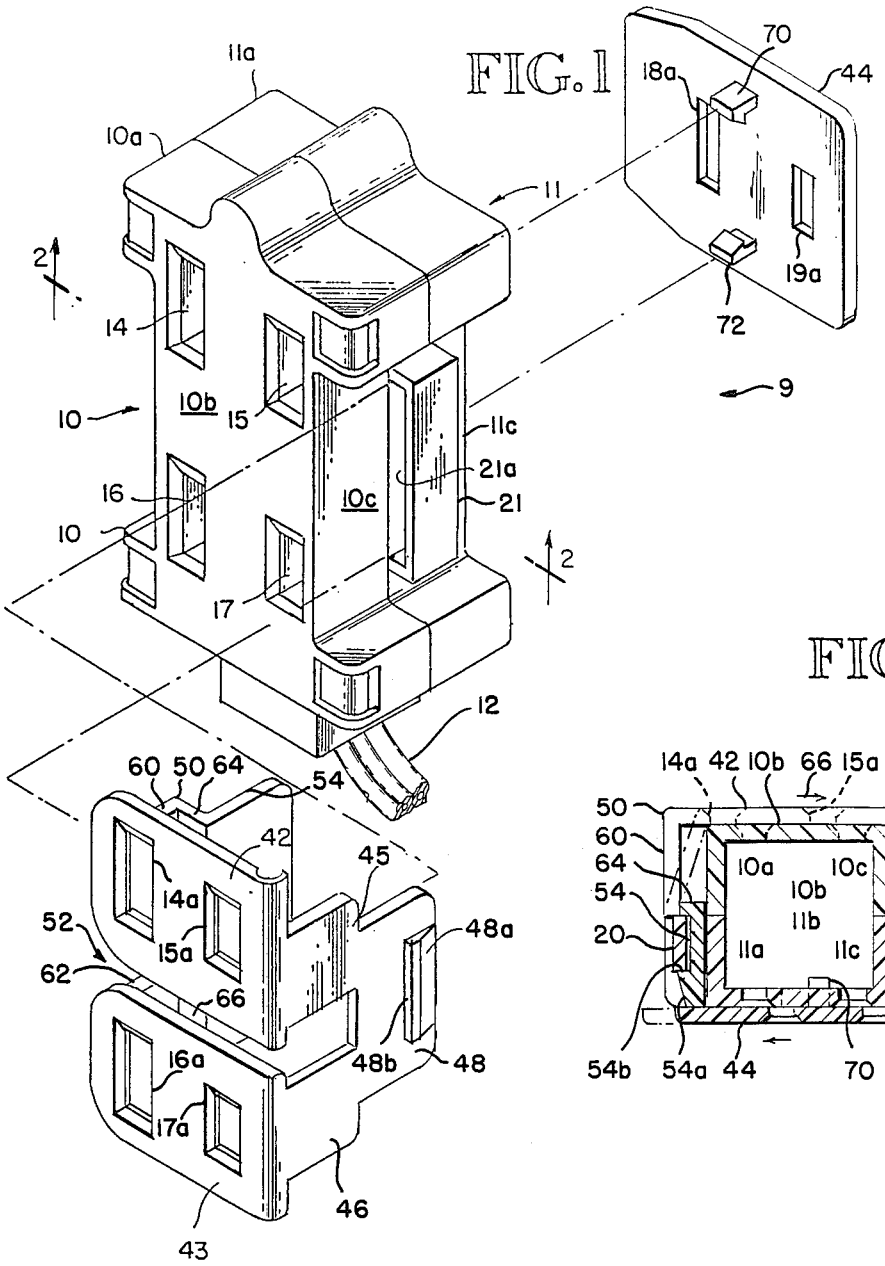
FIG. 1 is an enlarged frontal, exploded, isometric view of an end connector employing the present invention.

Referring to the drawings, an end connector 9 with a two-part housing 10, 11 has internal conductor elements (not shown) connected to wire conductors in an electrical cord 12. At one side, the housing 10 has two sets of openings 14, 15 and 16, 17 for receiving the blades from two end plugs. For purposes of example, the openings 14 and 16 are enlarged to receive polarized blades. At its opposite side (see FIG. 3), the housing 11 has a single pair of blade-receiving openings 18, 19, with the opening 18 being enlarged to receive the polarized blade. For purposes of example, the housing 10 is shown as being the same as that shown in my aforesaid issued application.

As part of the present invention, the housing 11 is provided with two U-shaped side brackets, or retaining bridge elements, 20, 21 made integral therewith. The bridge element 20 (see FIG. 3) extends outwardly from one side wall 11*a* of the housing, which adjoins a face 11*b* containing the single set of blade-receiving openings 18, 19. The other bridge element 21 extends outwardly from an opposite side wall 11*c* adjoining the face 11*b* containing the single set of blade-receiving openings 18, 19.

Flat cover elements 42, 43 and 44 are provided having respective sets of through openings 14*a*–15*a*, 16*a*–17*a*, and 18*a*, 19*a* arranged for registering respectively with the three sets of blade-receiving openings 14–15, 16–17 and 18–19 when the cover elements are in an inactive position, i.e., when plugs are engaged with the end connector.

The two cover elements 42, 43 have respective first integral leaf spring elements 45, 46 extending at approximately right angles thereto and on one side of the connector 9. The two cover elements also have respective second integral leaf spring elements 50, 52 also extending at approximately right angles thereto on the other side of the end connector.

The leaf spring elements 45, 46 and 50, 52 are connected together remote from the cover elements 22, 23 by mounting elements 48, 54. The lower end portion of the mounting elements 48 and 54 are provided with respective outer retaining elements 48*a* and 54*a*, which are tapered inwardly from stop faces 48*b*, 54*b*. These stop faces are slightly wider than gaps 20*a*, 21*a* (slots) between the bridge elements 20, 21 and the opposing housing walls 11*a*, 11*c*. The retaining elements 48*a*, 54*a* are thus provided with a snap fit with the bridge elements when the leaf spring elements are pushed endwise toward the bridge elements during assembly. The stop faces clear the bridge elements and prevent separation of the cover elements and integral spring leaf elements from the end connector housings 10, 11.

When the leaf spring elements 45, 46 are in a relaxed condition, they rest against the adjacent housing walls 10*c*, 11*c* of the housings 10, 11. The leaf spring elements 50, 52 have first portions 60, 62, respectively, which are spaced apart from the housing wall 10*a*. The clearance therebetween is established by transverse second portions 64, 66 which join the first portions with the mounting element 54.

Figure 2:
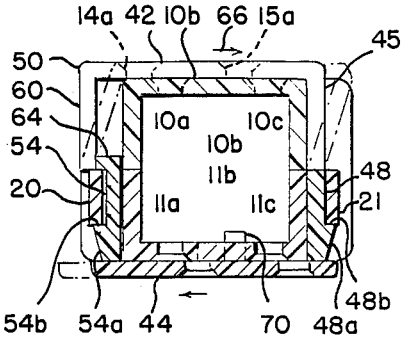
FIG. 2 is a sectional view, taken generally along line 2—2 of FIG. 1.

As best seen in FIG. 2, the sets of openings in the cover elements 42, 43 are slightly offset from the respective sets of blade-receiving openings in the housing face 10*b*. When it is desired to connect an extension cord plug with end connector by inserting the blades of the plug in a selected set of the blade-receiving openings, the respective cover is pushed endwise in the direction of arrow 66 until the set of openings in the plug register with the underlying set of blade-receiving openings in the housing. This registration can be most easily accomplished by inserting the plug blades in the cover openings and then pushing the plug slightly toward the respective leaf element while gently pushing the plug toward the housing. In this regard, the mouths of all of the openings are preferably tapered to guide the plug blades.

It takes very little side pressure on the plug being inserted before it starts to enter the tapered mouth of the underlying openings in the housing. Then, further endwise pressure on the plug causes the cover element 42 or 43 to shift further endwise until its openings come into full registration with the underlying blade-receiving openings in the housing 11 of the end connector. As indicated by the phantom position in FIG. 2, the endwise increment of movement of the cover causes the respective leaf spring element 45 or 46 to bend away from the housing 11, and the respective spring element 50 or 52 to bend toward the housing, thereby providing a spring bias so that when the plug is later removed, the cover will automatically spring back into its inactive position, covering the blade-receiving openings in the housing 11.

The described parts and arrangement thereof permit the housings 10, 11 and combination cover-leaf spring units to be injection molded from suitable plastic and to be readily assembled without need of additional fastening elements. The housing can be snap-fitted, as shown, or ultrasonically welded.

Figure 3:
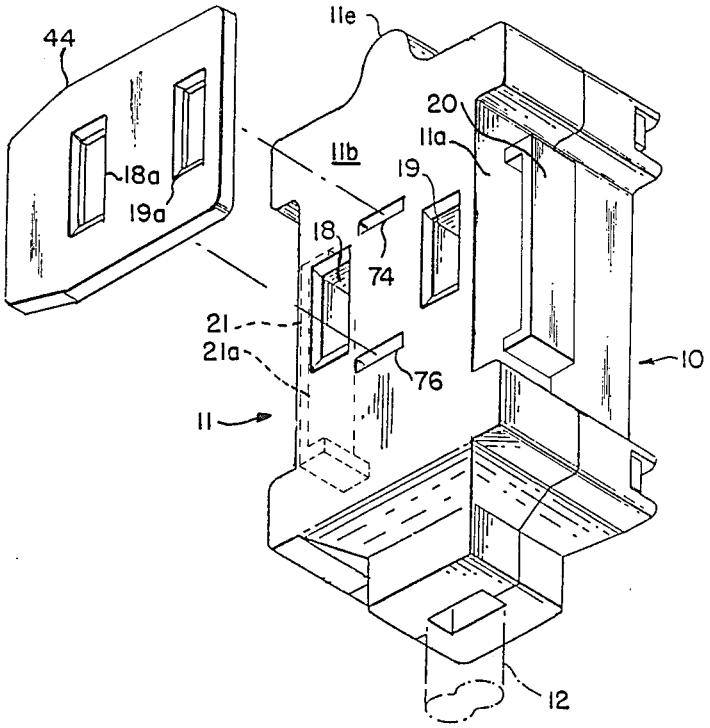
FIG. 3 is an enlarged rear, exploded, isometric view of the end connector.

As best seen in FIGS. 1 and 3, cover element 44 has enlarged prongs 70, 72 which engage slots 74, 76 in the housing face 11*b*. Slots 74, 76 are elongated to allow translational movement of the cover element 44 in the direction of arrow 78 to the dotted-line position shown in FIG. 2. The cover element 44 does not automatically return to the safety position, shown in solid in FIG. 2, as do the cover elements 42, 43.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. An electrical connector comprising:

an electrical connector housing having a wall formed with two side-by-side sets of socket openings for receiving two sets of plug blades;

a pair of side-by-side, independently operating safety covers adjacent said wall, each having a matching set of openings adapted to register with a respective said socket opening set when the latter set is in use and the safety cover is in an active position;

a pair of leaf spring elements spaced apart and connected at one of two opposite ends thereof to respective ones of said safety covers for independently holding the safety covers in a safety position whereat said matching sets of openings are offset from said socket opening sets, said leaf spring elements being mounted on said housing by a single mounting element bridging between the other of said two opposite ends of said leaf spring elements and interfitting with the housing, whereby said leaf spring elements are independently biased when the respective safety cover is moved from its safety position to its said inactive position; and retaining means independent of said leaf spring elements and connected to said safety covers in spaced relation to said leaf spring elements, said retaining means interfitting with said housing for restricting movement of said safety covers away from said housing wall while permitting independent movement of said safety covers over said wall between their safety and inactive positions.

2. An electrical connector according to claim 1 in which said retaining means and mounting element have a snap interfit with said housing.

3. An electrical connector according to claim 1 in which said leaf spring elements are located externally of said wall of the housing.

* * * * *